US006779676B2

(12) United States Patent
Ciccone

(10) Patent No.: US 6,779,676 B2
(45) Date of Patent: Aug. 24, 2004

(54) CONTAINER LID WITH TEAR-OFF STRIP

(75) Inventor: Vince Ciccone, Kleinburg (CA)

(73) Assignee: Injectnotech Inc., Mississauga (CA)

( * ) Notice: Subject to any disclaimer, the term of this patent is extended or adjusted under 35 U.S.C. 154(b) by 47 days.

(21) Appl. No.: 10/365,114

(22) Filed: Feb. 11, 2003

(65) Prior Publication Data

US 2003/0160051 A1 Aug. 28, 2003

Related U.S. Application Data

(63) Continuation-in-part of application No. 09/811,413, filed on Mar. 20, 2001, now Pat. No. 6,543,635, which is a continuation-in-part of application No. 09/451,421, filed on Nov. 30, 1999, now abandoned.

(51) Int. Cl.[7] ..... B65D 17/40
(52) U.S. Cl. ..... 220/276; 215/254
(58) Field of Search ..... 220/276, 277, 220/278, 280, 284, 285, 286, 786, 792, 795, 784, 274; 215/254, 256

(56) References Cited

U.S. PATENT DOCUMENTS

| | | | | |
|---|---|---|---|---|
| 4,385,708 A | | 5/1983 | Curry | |
| 4,625,876 A | | 12/1986 | Bullock, III | |
| 4,711,364 A | * | 12/1987 | Letica | 220/276 |
| 4,735,337 A | | 4/1988 | Von Holdt | |
| 4,881,656 A | * | 11/1989 | Chumley et al. | 220/270 |
| 4,930,656 A | | 6/1990 | Blanchette | |
| 5,046,632 A | | 9/1991 | Bordner | |
| 5,238,135 A | * | 8/1993 | Landis | 220/276 |
| 5,294,015 A | * | 3/1994 | Landis | 220/784 |
| 5,395,003 A | | 3/1995 | Matsuda | |
| 5,540,349 A | * | 7/1996 | Philips | 220/780 |
| 5,626,251 A | | 5/1997 | Luburic et al. | |
| 5,730,309 A | | 3/1998 | Jiradejnunt et al. | |
| 5,873,484 A | | 2/1999 | Clute et al. | |
| 6,543,635 B2 | * | 4/2003 | Ciccone | 220/276 |
| 6,619,498 B2 | * | 9/2003 | von Holdt, Jr. | 220/276 |

FOREIGN PATENT DOCUMENTS

| | | |
|---|---|---|
| CA | 2163306 | 5/1997 |
| EP | 0 052 172 A1 | 5/1982 |
| EP | 0 723 918 A1 | 7/1996 |
| FR | 2 103 410 A1 | 4/1972 |

* cited by examiner

*Primary Examiner*—Lien Ngo
(74) *Attorney, Agent, or Firm*—Hodgson Russ LLP

(57) ABSTRACT

A plastic lid is disclosed for a container having double locking flanges around its upper peripheral edge for locking engagement with the lid. The lid has central portion and peripheral annular skirt. The skirt has a peripheral groove dividing the skirt into an upper portion and a lower tear-off strip portion. The upper portion has intermittent locking flange segments for engaging the container locking flanges. The tear-off strip portion has a second locking flange for engaging the other of the container locking flanges. Thin membrane windows are formed in the skirt upper portion on either side of the intermittent locking flange segments and bordering on the annular groove, so that the membrane windows form weakened notches upon removal of the tear-off strip. Recessed portions on the outer surface of the skirt upper portion mark the location of the locking flange segments.

9 Claims, 14 Drawing Sheets

CONTAINER LID WITH TEAR-OFF STRIP

RELATED APPLICATION

This is a continuation-in-part application of U.S. application Ser. No. 09/811,413 filed Mar. 20, 2001, now U.S. Pat. No. 6,543,635, itself being a continuation-in-part of U.S. application Ser. No. 09/451,421 filed Nov. 30, 1999, abandoned.

FIELD OF THE INVENTION

This invention relates to plastic containers, and in particular, to lids for such containers where the lids have tear-off strips to facilitate the removal of the lids.

BACKGROUND OF THE INVENTION

In larger plastic containers, such as paint containers capable of holding many liters of paint, it is necessary to provide a strong attachment and good seal between the container and the lid, especially for shipping purposes. Usually, interlocking or inter-engaging flanges are provided on the lid and the upper peripheral edge portion of the container to retain the lid on the container. The difficulty is that the stronger is the engagement between these interlocking flanges, and thus the stronger the attachment of the lid to the container, the more difficult it is to remove the lid when it is desired to do so. Ideally, one would like to have good engagement between the lid and the container for shipping purposes, and some means for relieving or reducing the force of engagement between the lid and the container when it is desirable to remove the lid.

One method of accomplishing the above objectives is to provide the lid with a tear-off strip that contains the lid locking flange that engages the container locking flange. When the lid is on the container, the engaged locking flanges hold the lid securely onto the container. When it is desired to remove the lid, the lid tear-off strip is removed, so there is no longer any locking engagement between the lid and the container. The lid is then easy to remove.

Sometimes, however, after the lid is removed, it is desirable to put the lid back on the container and still have a good seal between the lid and the container. One way of achieving this result is shown in U.S. Pat. No. 4,735,337 issued to John W. Von Holdt. In this patent, the lid outer skirt that contains the locking flange is provided with a zigzag tear line that defines a tear-off strip. The tear line passes repeatedly through the locking flange, so that upon removal of the tear-off strip, portions of the locking flange are removed and only spaced-apart portions of the lid skirt locking flange remain. These remaining portions then provide a lid lock with reduced holding power, so that the lid can be removed and replaced.

Another example of such a lid is shown in U.S. Pat. No. 4,930,656 issued to Henry J. Blanchette. In this Blanchette patent, an intermittent locking flange is provided on the lid peripheral skirt and an undulating annular groove is provided to form a tear-off strip. When the tear-strip is removed, the lid ends up with bendable flaps containing the locking flanges, and these flaps yield to permit easier removal and replacement of the lid.

One difficulty with the prior art Von Holdt and Blanchette patents is that the zig zag or undulating tear-off strips are difficult to remove. The tooling to make the lids shown in these patents is also expensive because of the complex nature of the tear lines. The lid shown in the Blanchette patent is also not as strongly retained on the container as would be desired, because only partial locking flanges are provided on the lid skirt.

SUMMARY OF THE INVENTION

In the present invention, a double locking flange is provided to securely hold the lid on the container. One of the locking flanges is totally removed along with the tear-off strip leaving a second, intermittent yieldable locking flange for retention and resealing of the lid on the container.

According to the invention, there is provided a lid for a container having upper and lower peripheral, annular outwardly disposed locking flanges, the flanges having undersides for locking engagement with the container lid. The lid comprises a central portion and a peripheral skirt adapted to overlie the container locking flanges. The peripheral skirt defines a peripheral groove dividing said skirt into a skirt upper portion located adjacent to the container upper locking flange, and a lower tear-off strip portion located adjacent to the container lower locking flange. The skirt upper portion has inwardly disposed intermittent locking flange segments adapted to engage the underside of the container upper locking flange. The skirt upper portion is also formed with thin membrane windows therein, each said window covered by a thin membrane. The windows are positioned circumferentially adjacent to both sides of the locking flange segments and border on the peripheral groove. The skirt upper portion includes an outer surface. The outer surface includes a recessed portion at the position of the inwardly disposed intermittent locking flange segments, thereby indicating the location of the locking flange segments. The tear-off strip portion defines an inwardly disposed locking flange adapted to engage the underside of the container lower locking flange, so that removal of the tear-off strip portion leaves downwardly disposed thin membrane notches on either side of the locking flange segments.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENT

Figure 1:
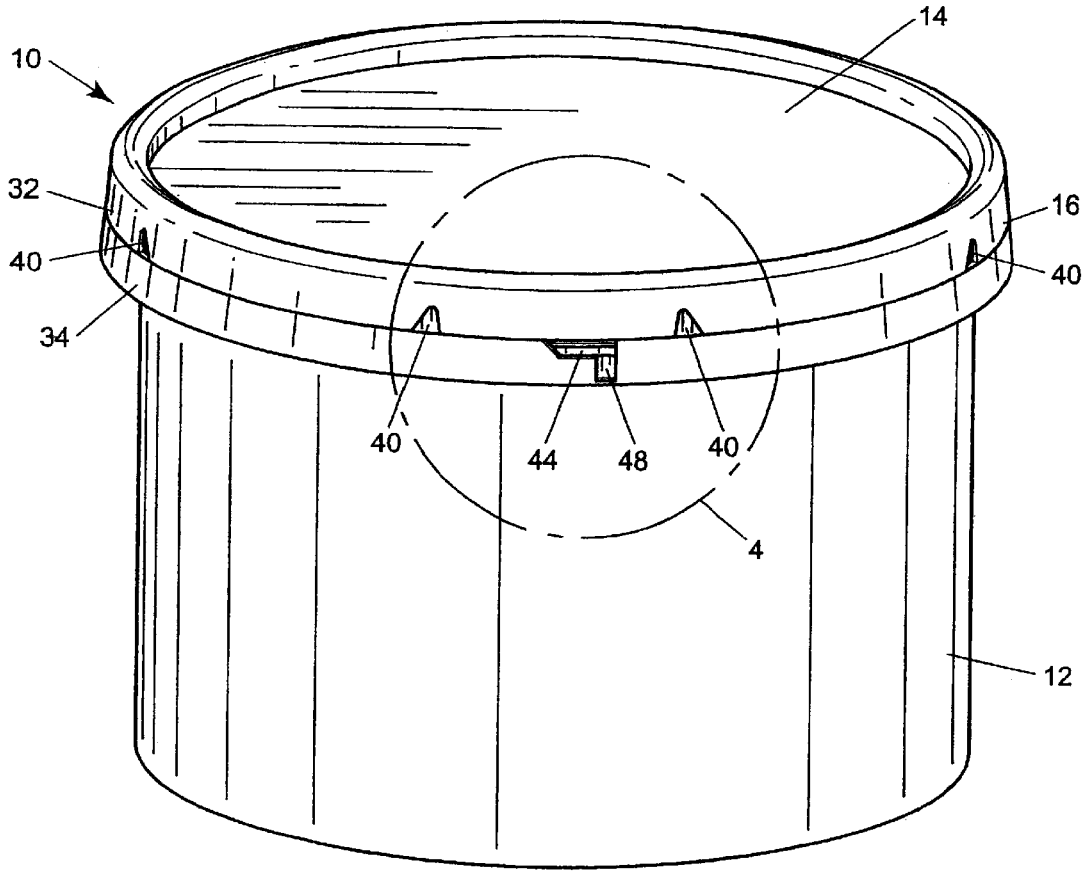
FIG. 1 is a perspective view of a preferred embodiment of a lid according to the present invention shown mounted on a container.

Referring firstly to FIG. 1, a preferred embodiment of a container lid according to the present invention is generally located by reference numeral 10. Lid 10 is shown mounted on a container 12, but container 12 is not considered to be part of the present invention per se. Lid 10 includes a planar central portion 14 and a peripheral annular skirt 16. The size of container 12 is such that it holds typically from about 4 to 20 liters, and container 12 and lid 14 are most commonly made from plastic, such as polyethylene or polypropylene. However, any plastic or other material can be used for lid 10 that has some resiliency, as will be described further below.

Figure 2:
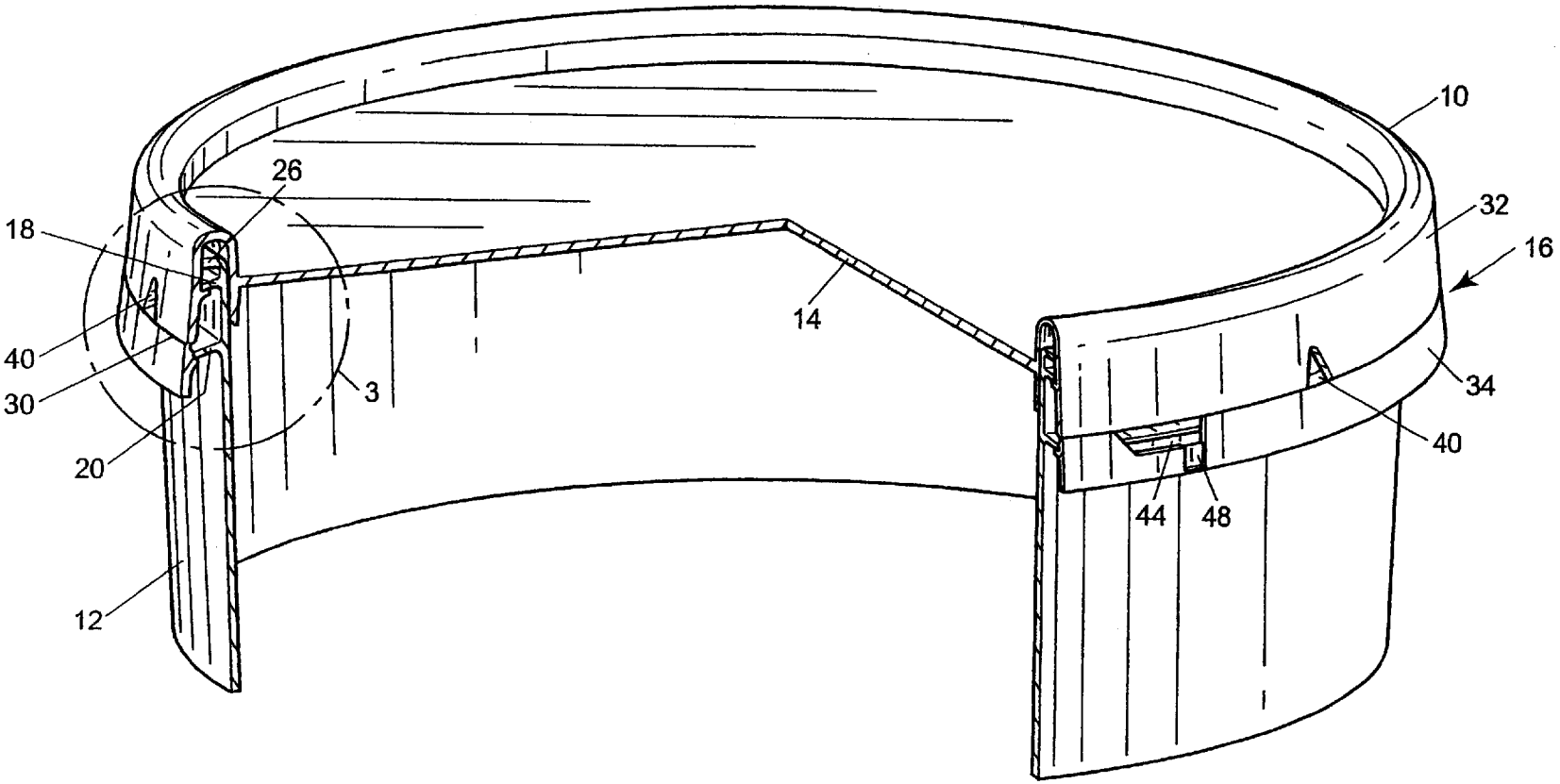
FIG. 2 is an enlarged perspective view, partly broken away, showing the interlocking flanges between the lid and container shown in FIG. 1.
Figure 3:
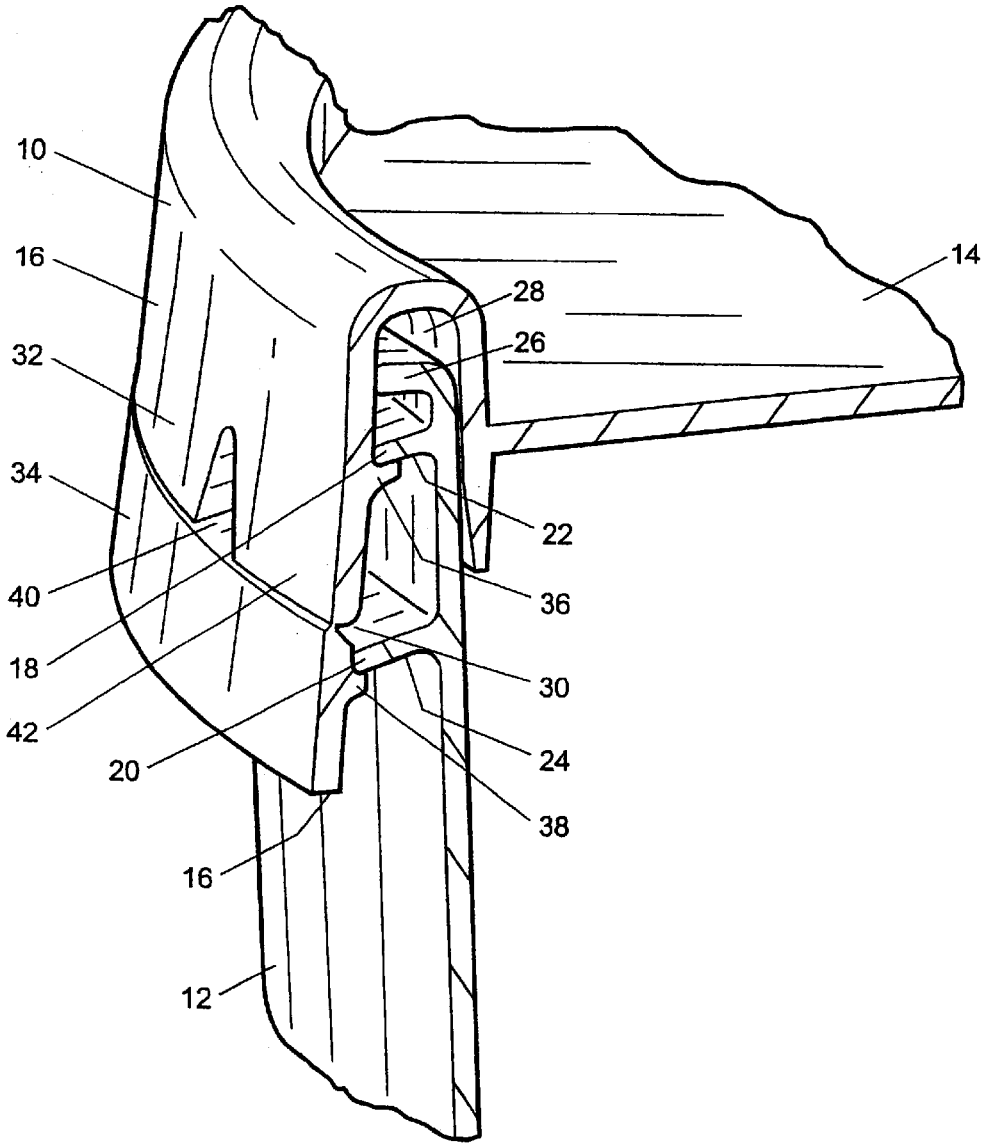
FIG. 3 is a further enlarged perspective view of the portion of FIG. 2 indicated by chain-dotted circle 3.

Referring next to FIGS. 2 and 3, container 12 is shown having an upper, peripheral, annular, outwardly disposed locking flange 18 and a lower, annular, outwardly disposed locking flange 20 spaced from or below locking flange 18. Locking flanges 18, 20 have respective undersides 22, 24 for locking engagement with lid 10, as described further below. Container 12 also has a further peripheral annular flange 26 which forms the rim or brim of container 12, and which is located in an annular sealing groove 28 in lid 10 located between the lid central portion 14 and the peripheral annular skirt 16. When lid 10 is located on container 12, the container annular flange 26 is wedged into lid sealing groove 28 to provide a good seal between the container and the lid. In other words, sealing groove 28 sealingly engages the rim 26 of the container. If desired, a gasket (not shown) can be used in groove 28, or groove 28 can be smaller than that shown in the drawings.

As seen best in FIG. 3, the lid annular skirt 16 overlies the container locking flanges 18, 20. Annular skirt 16 defines or has an annular groove 30 which divides skirt 16 into a skirt upper portion 32 located adjacent to the container upper locking flange 18, and a lower tear-off strip portion 34 located adjacent to the container lower locking flange 20. Annular groove 30 can be on the inside surface of annular skirt 16 or the outside surface of this skirt, or partially in both, as shown in FIG. 3.

As seen best in FIGS. 3 and 4 to 6, the skirt upper portion 32 is formed with inwardly disposed intermittent locking flange segments 36 which are adapted to engage the underside 22 of the container upper locking flange 18. Similarly, the tear-off strip portion 34 defines or has an inwardly disposed locking flange 38 which is adapted to engage the underside 24 of the container lower locking flange 20.

Figure 4:
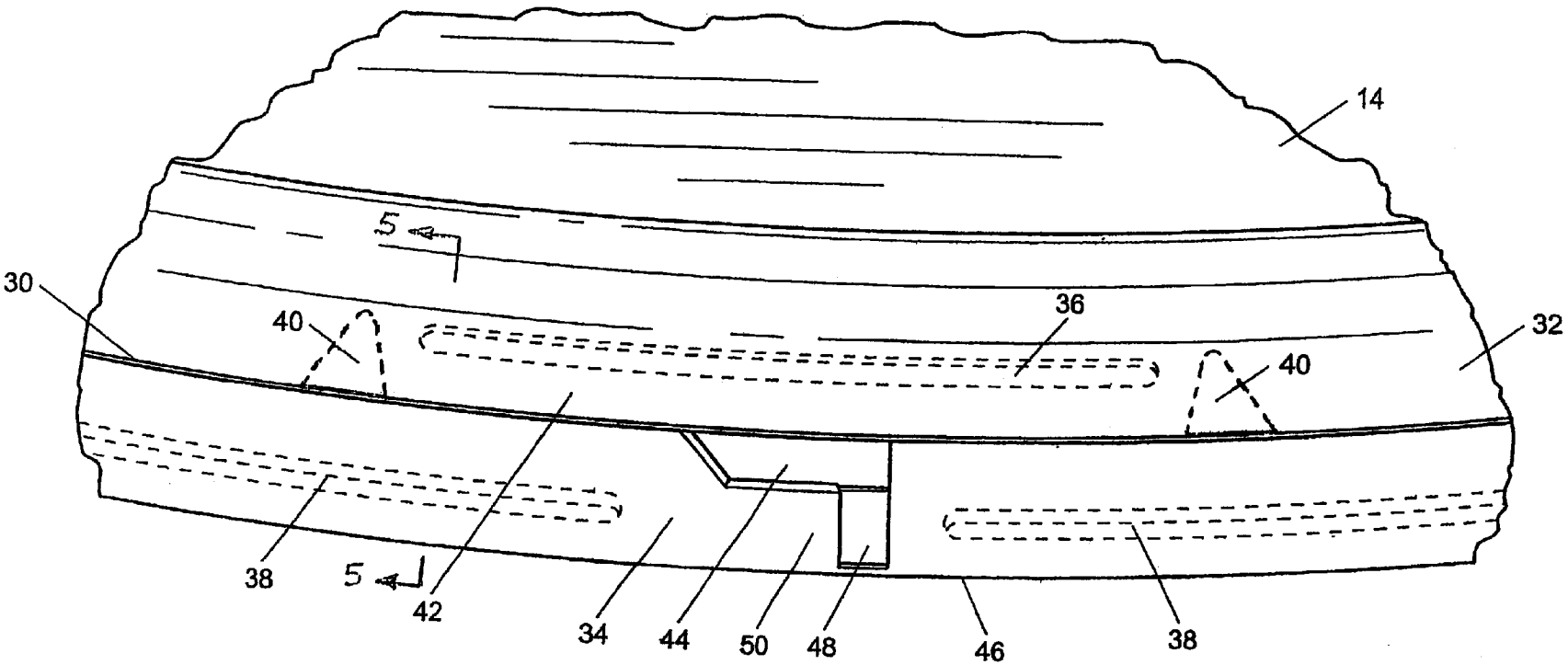
FIG. 4 is an enlarged view of the portion of FIG. 1 indicated in by chain-dotted circle 4.
Figure 4A:
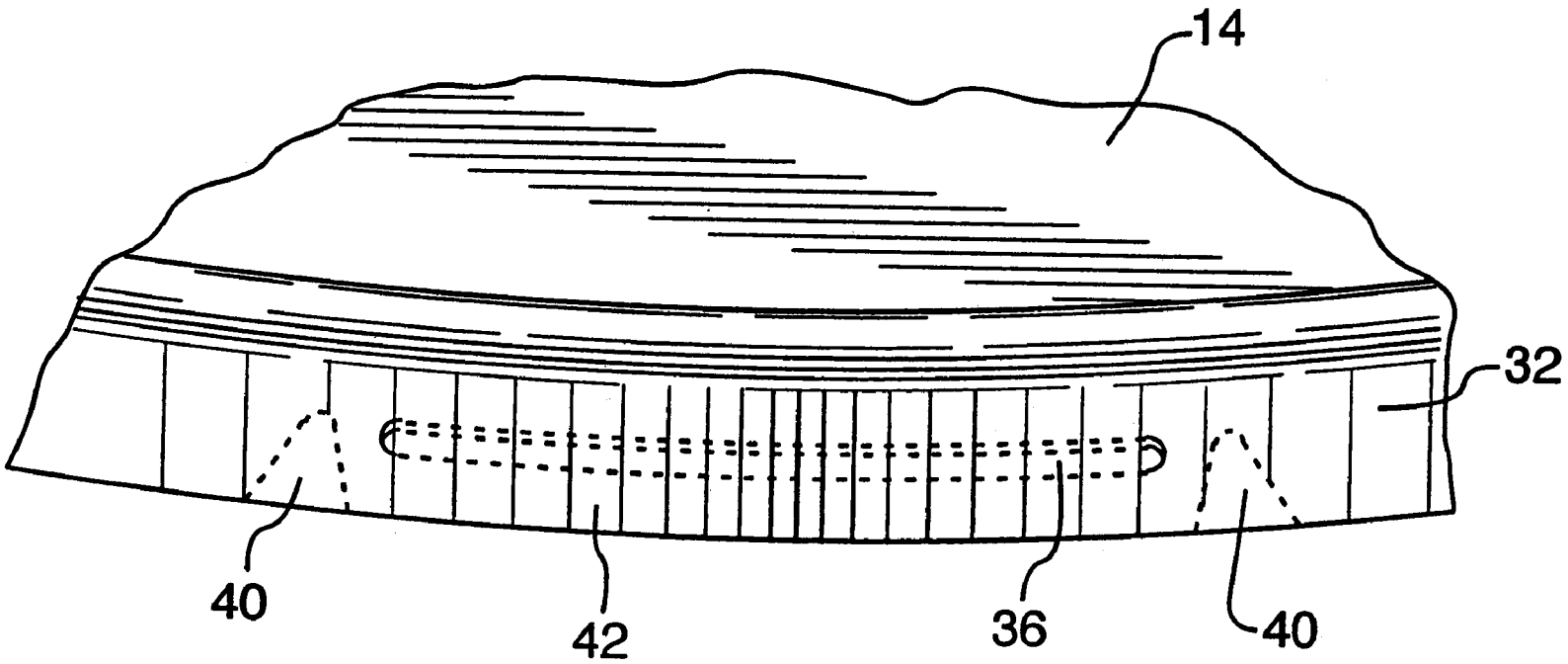
FIG. 4*a* is an enlarged view of the portion of FIG. 1 indicated by chain dotted circle 4 but showing the tear-off strip removed.
Figure 5:
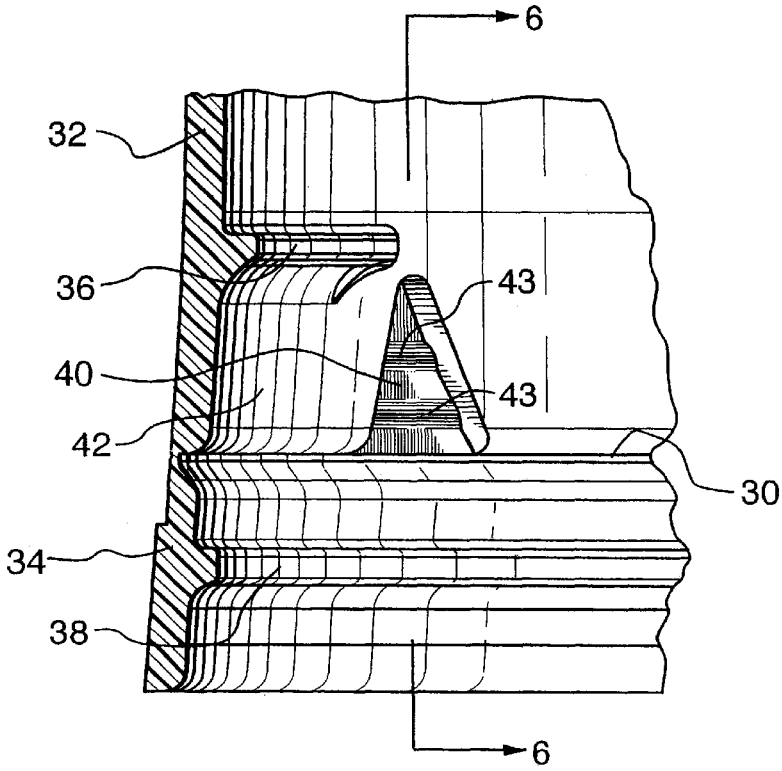
FIG. 5 is an enlarged elevational view taken along lines 5—5 of FIG. 4.
Figure 6:
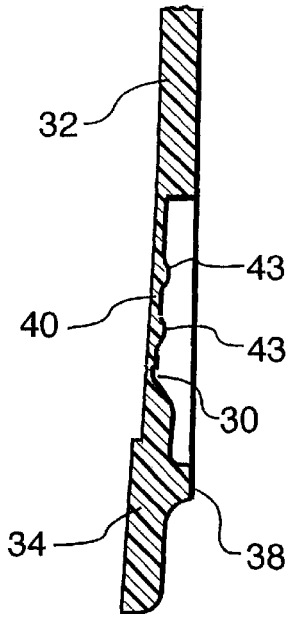
FIG. 6 is a sectional view taken along lines 6—6 of FIG. 5.

As seen best in FIGS. 4, 5 and 6, skirt upper portion 32 is formed with triangularly shaped thin membrane windows 40 therein on either side of the locking flange segments 36. Windows 40 border on the annular groove 30, so that upon removal of tear-off strip portion 34, as will be described below, as shown in: FIG. 4*a*, windows 40 turn into downwardly disposed V-shaped, weakened areas on either side of the locking flange segments 36. The part of skirt or upper portion 32 located between windows 40 that contains locking flange segments 36 thus becomes a flap 42 that can be pried outwardly and upwardly to release the locking flange segments 36 from container upper locking flange 18 and thus allow for the easy removal of lid 10 from container 12. The thin membrane windows can tear as flaps 42 are pried upwardly, or, if windows 40 are made thicker, they can stretch elastically and act as springs to help return flaps 42 to the locking position. The membranes of windows 40 typically are about 0.2 to 0.5 mm (0.008 to 0.020 inches) thick, and prevent dirt or other foreign matter from entering windows 40 and collecting on flange 20. If desired, membrane windows 40 can have strengthening or reinforcing ribs 43, especially if it is desired that the membranes not tear upon the lifting of flaps 42. With ribs 43, flaps 42 will more readily resume their original shape after being lifted.

Figure 7:
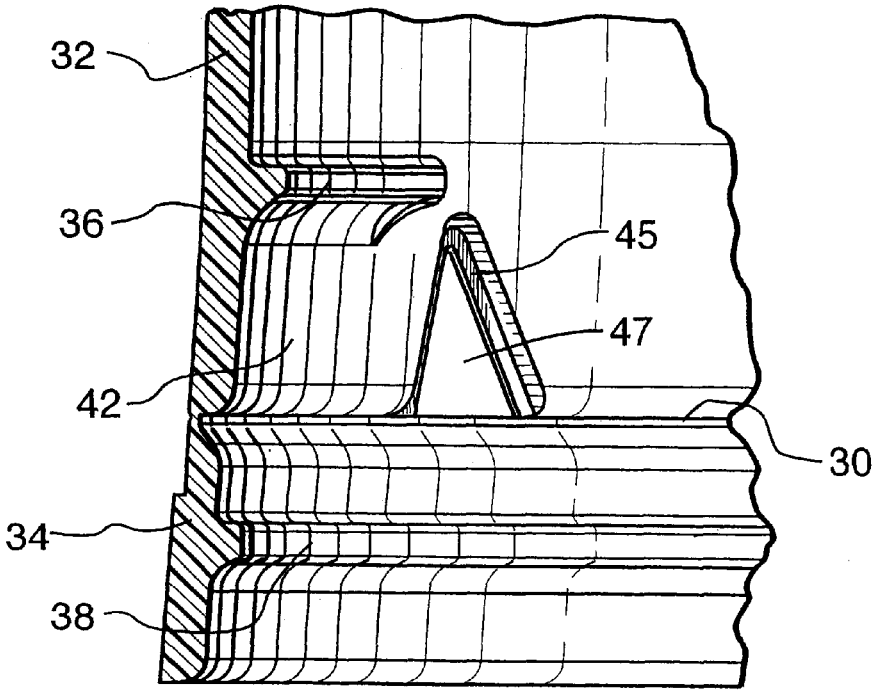
FIG. 7 is an elevational view similar to FIG. 5 but showing a modified thin membrane window.
Figure 7A:
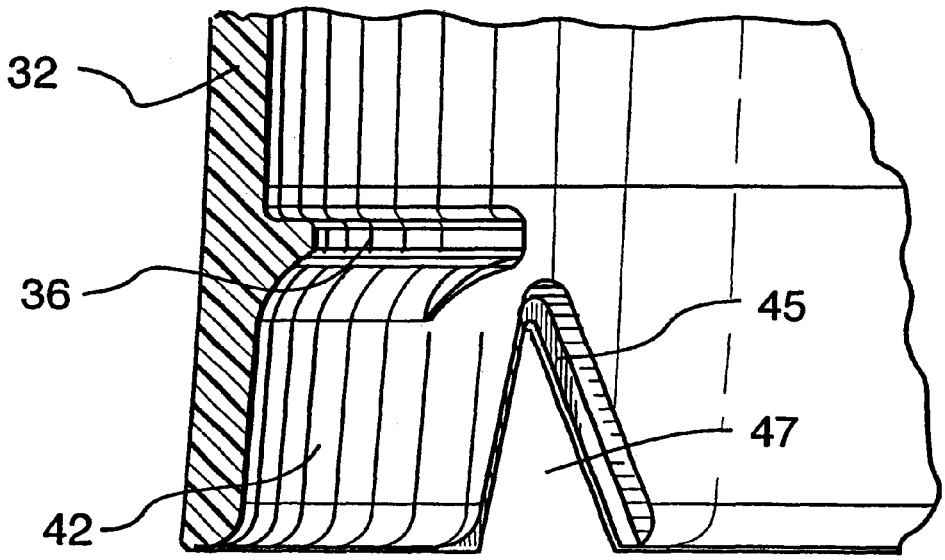
FIG. 7*a* is an elevational view similar to FIG. 7 but showing the tear off strip removed.

Referring next to FIG. 7, a modified membrane window 45 is shown where the membranes have openings 47 therethrough bordering on the annular groove 30. As shown in FIG. 7*a*, the removal of tear-off strip portion 34 thus leaves downwardly disposed open, inverted V-shaped open notches on either side of the locking flange segments 36 to make the lifting of flaps 42 easier. The openings or notches 47 can be any shape or configuration desired, even narrow vertical slits, if it is desired to prevent dirt or debris from passing through windows 45.

As seen best in FIG. 4, tear-off strip portion 34 is formed with a window 44 located adjacent to annular groove 30. Again, window 44 could have a thin wall or membrane covering to keep dirt out, or it could be an actual opening formed in tear-off strip portion 34. Tear-off strip portion 34 has a lower peripheral edge 46, and tear-off strip portion 34 is formed with a reduced thickness portion 48 located between window 44 and lower peripheral edge 46. To remove tear-off strip portion 34, one can insert a tool, such a screwdriver into window 44 and pry the tear-off strip portion 34 outwardly to break reduced thickness portion 48. This provides a flap or tab 50 that can be grasped and pulled outwardly to tear the tear-off strip portion 34 along groove 30 to remove tear-off strip portion 34. It will be appreciated that removal of tear-off strip 34 also removes the locking flange or flanges 38, leaving only the intermittent locking flange segments 36 to engage the container. This permits lid 10 to be removed easily by prying up flaps 42, yet the intermittent locking flange segment 36 permit lid 10 to be placed again on container 12 with good sealing engagement between the container rim or annular flange 26 and lid sealing groove 28. It will also be appreciated that breaking reduced thickness portion 48, and perhaps window 44, is a tamper evidence feature for lid 10.

Figure 8:
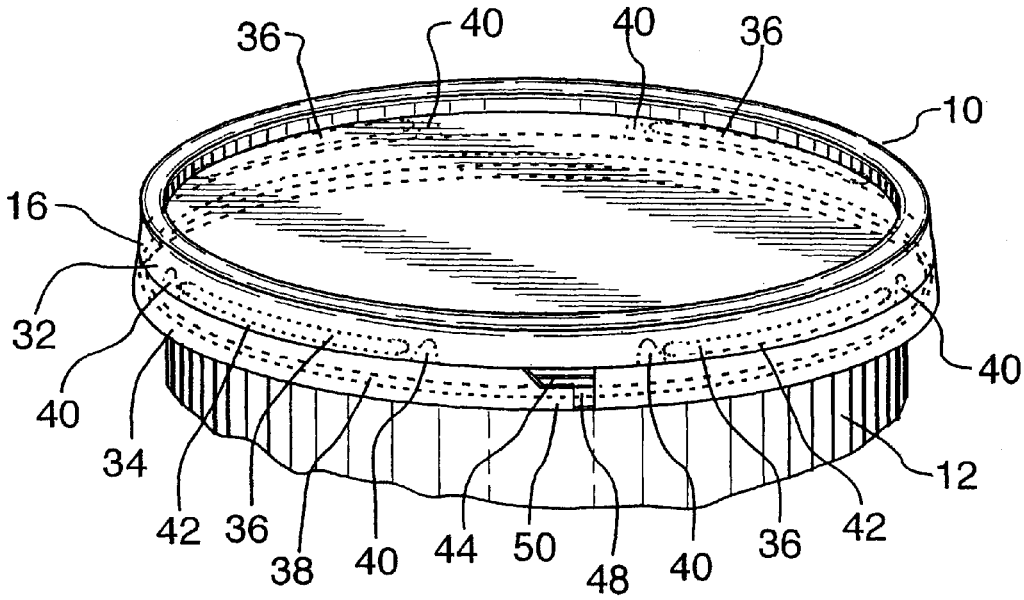
FIG. 8 is a perspective view of the upper portion of FIG. 1 showing one preferred embodiment of the locking flanges on the lid of the present invention.

Referring to FIG. 8, it will be seen that in this embodiment, lid 10 is provided with 4 equally-spaced intermittent locking flange segments 36 on the skirt upper portion 32. Also, tear-off strip portion 34 has an inwardly disposed locking flange 38 that is a continuous annular flange located around the inside of tear-off strip portion 34. Locking flange 38 passes over the reduced thickness portion 48, and depending on the thickness of locking flange 38, it may be necessary to insert a knife into window 44 and cut downwardly through locking flange 38 and reduced thickness portion 48 in order to break out tab 50 in this embodiment.

Figure 9:
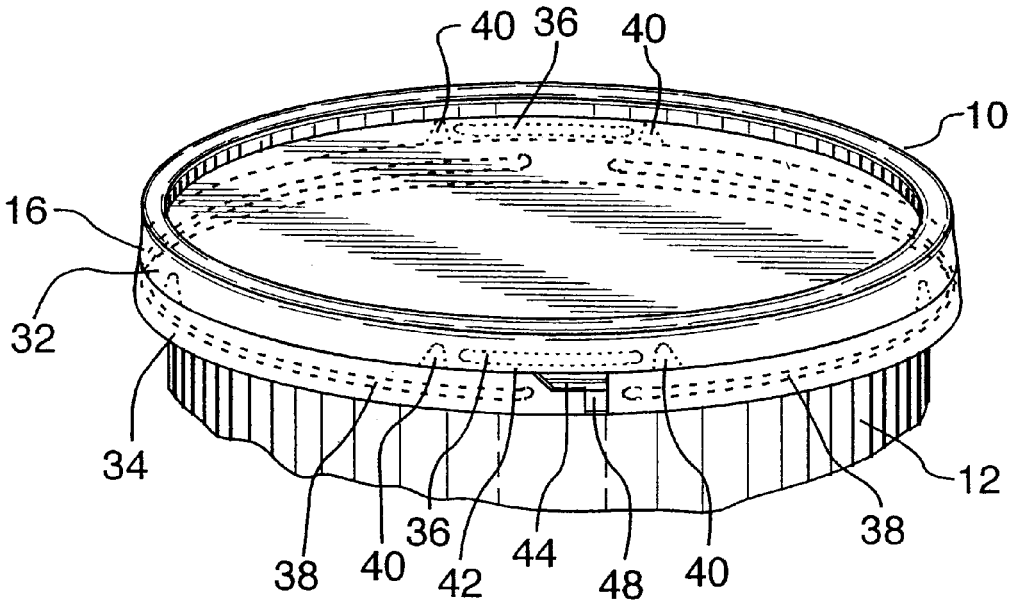
FIG. 9 is a perspective view similar to FIG. 8 but showing another preferred embodiment of the locking flanges on the lid of the present invention.

In the embodiment shown in FIG. 9, there are only two diametrically opposed locking flange segments 36 on the inside of skirt upper portion 32. Also, tear-off strip portion 34 has a pair of semi-circular and inwardly disposed locking flanges or flange segments 38 rather than a continuous locking flange 38. The FIG. 9 embodiment is useful for smaller containers where the lids need not be held so securely on containers 12. The FIG. 8 embodiment is useful for larger containers where stronger retention between the lid and the container is desired. In fact, locking flange segments 36 could be located between all of the pairs of openings 40 to make an even stronger connection between the lid and the container. It will be appreciated that the size and the length and the number of locking flanges 36 and 38 can be configured as desired to give the necessary shipping strength to the container and lid combination of the present invention, or to provide for easier or more difficult removal and reinstallation of lid 10 for the re-use of container 12.

Figure 10A:
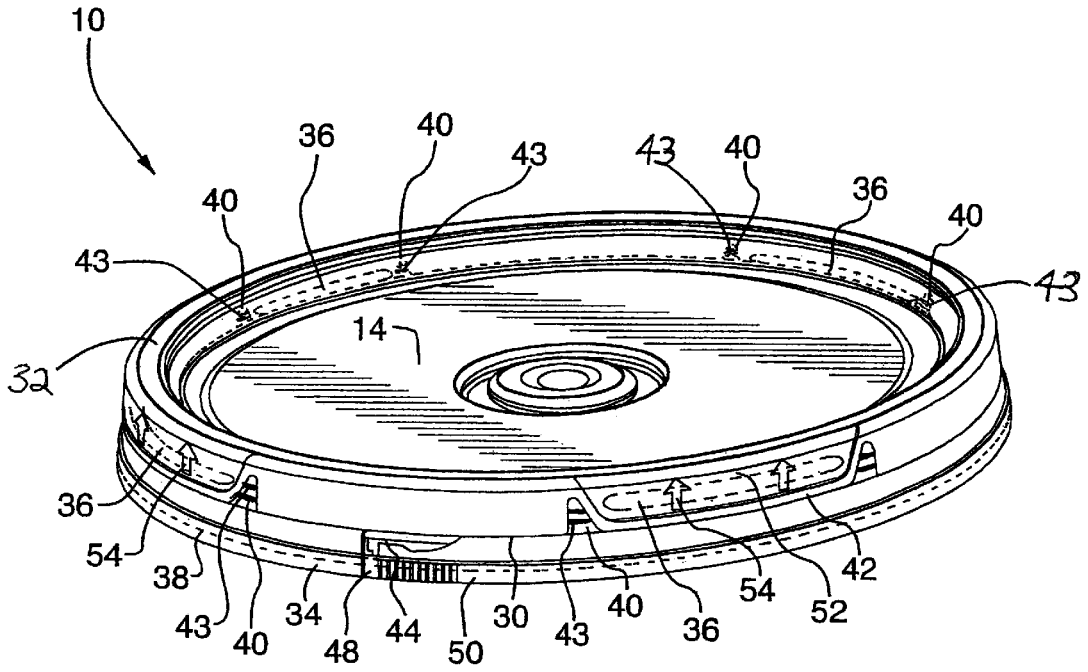
FIGS. 10A to 10C are perspective views of embodiments of the lid according to the present invention including indicator means on the outer surface of the lid.
Figure 10B:
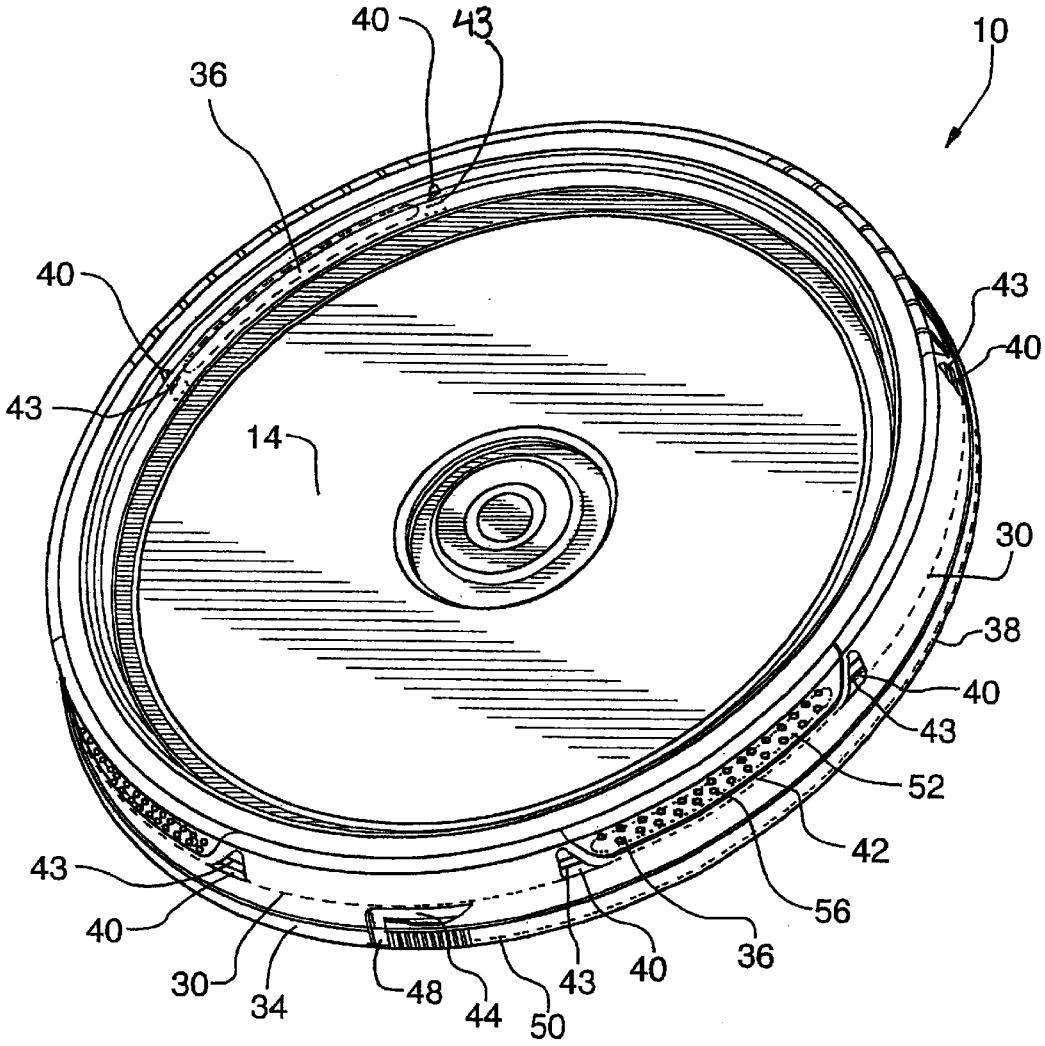
Figure 10C:
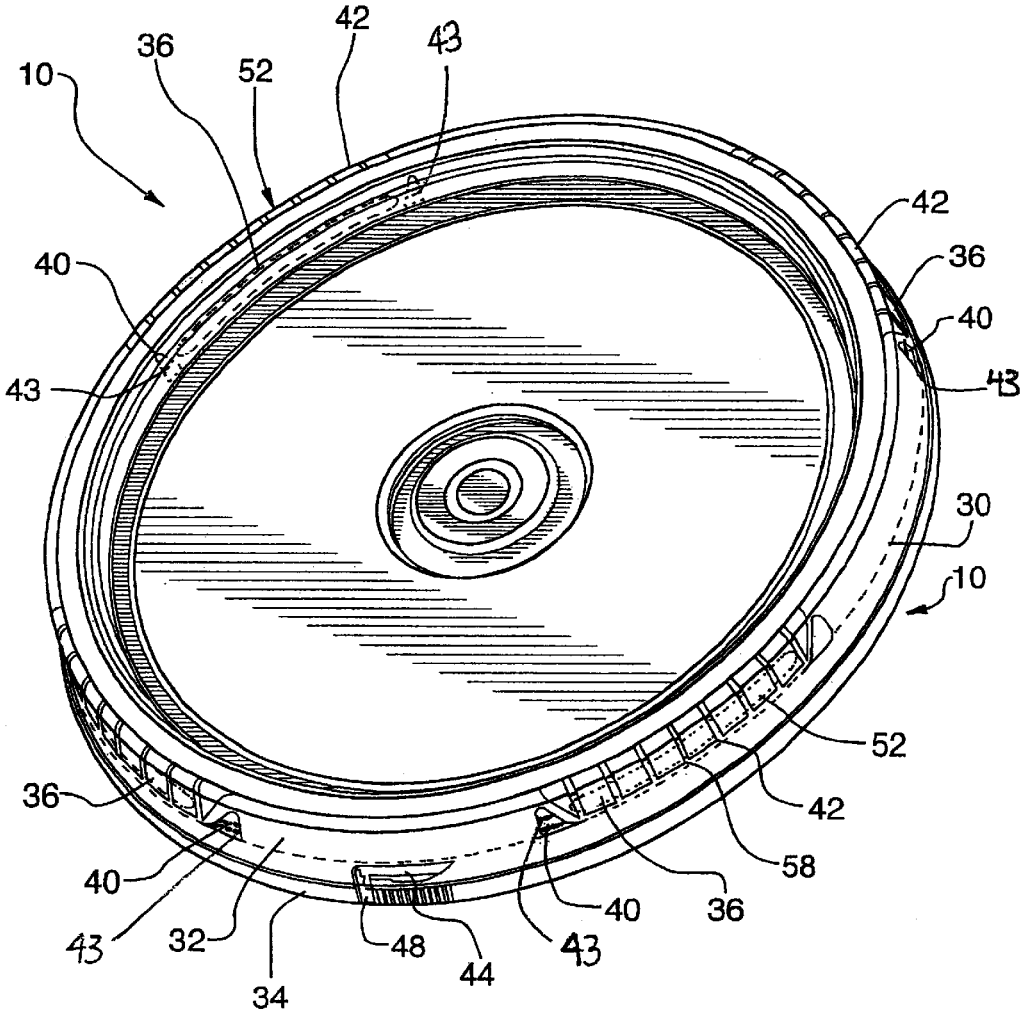

Shown in FIGS. 10A to 10C, are embodiments of the lid of the invention in which the outer surface of the skirt upper portion 32 corresponding to the position of the intermittent locking flange segment 36 includes indicator means on the outer surface, indicating to the user where to lift the flaps 42 when removing the lid 10 from the container, after the tear-off strip 34 has been removed. Shown in FIG. 10A is an embodiment including the features of the lid of FIG. 9 and further including indicator means comprises a recessed portion 52 which includes arrows pointing upwardly 54. The recessed portion and arrows indicate to the user where the intermittent locking flange 36 is located and thus where to lift the flap to disengage the lid from the upper outwardly disposed flange 18 of the container. Shown in FIGS. 10B and 10C are embodiments with Variations in the indicator means, namely in FIG. 10B a pattern of protrusions 56 are present in the recessed portion 52 and in FIG. 10C a high gloss patterned surface 58 are present in the recessed portion, indicating the position of the locking flange segments 36 and thereby where to lift the flaps 42. The recessed portion 52 in any of these embodiments may have a matted or textured surface. The thin membrane windows 40 of the embodiments shown in FIGS. 10A to 10C may include strengthening ribs 43, such as those shown in FIGS. 5 and 6. Such windows may be modified in the manner shown in FIG. 7.

Figure 11:
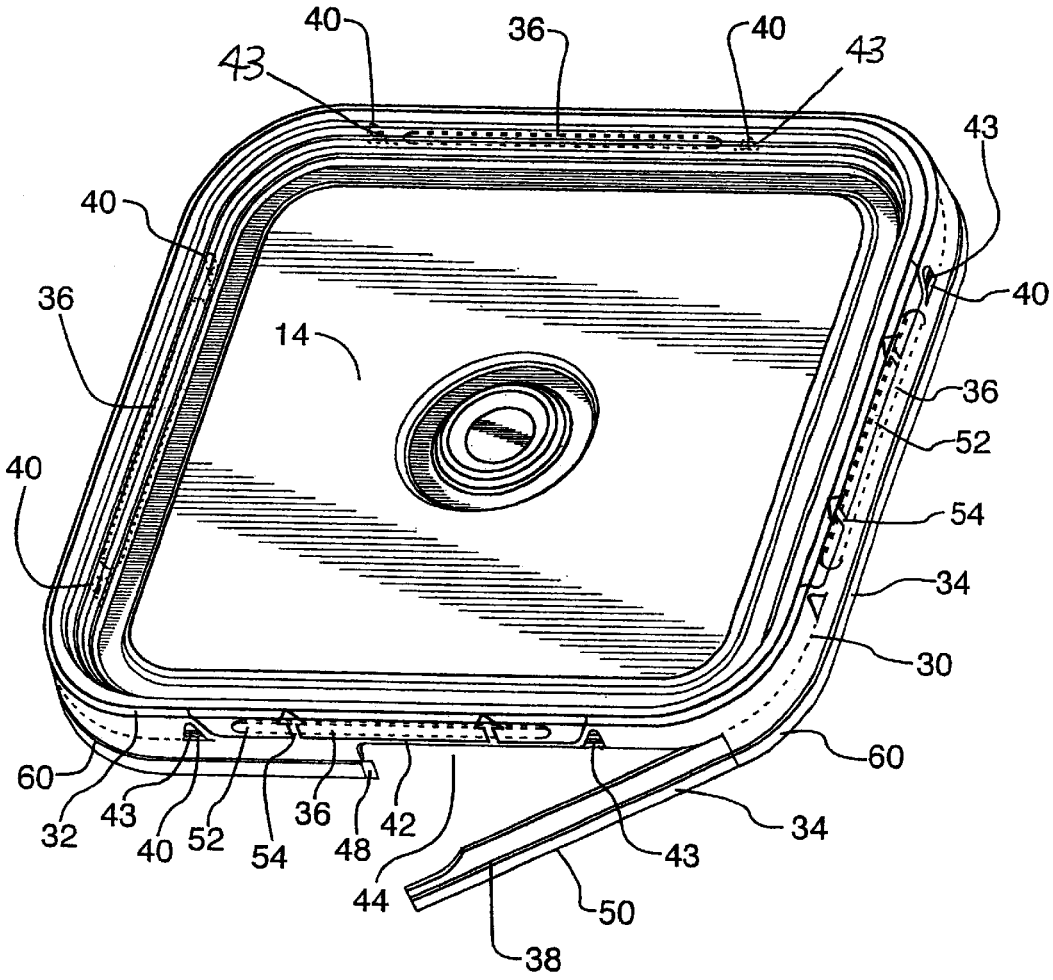
FIG. 11 is a perspective view of a first square shaped embodiment of a lid of the present invention.
Figure 12:
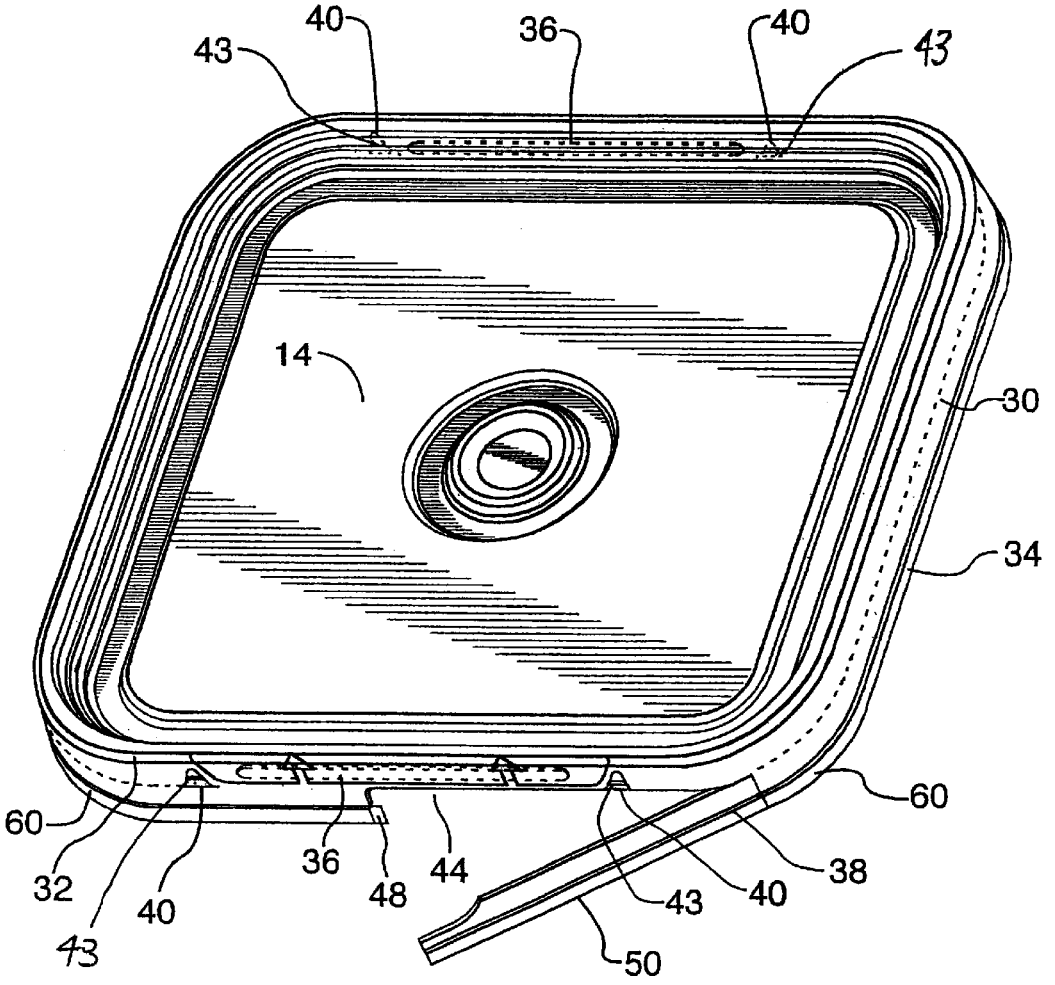
FIG. 12 is a perspective view of a second square shaped embodiment of a lid of the present invention.

It should be understood that the lid and container of the invention may be rectangular or square in circumference. Examples of square lid embodiments are shown in FIGS. 11 to 12. The square lids preferably include the features as described in the embodiments above and illustrated in the Figures herein and may be utilized in essentially the same manner. For example shown in FIG. 11 an embodiment of the lid 10 is provided with four intermittent locking flange segments 36 on the skirt upper portion 32, one on each side of the square for engaging the outwardly disposed locking flange 18 of the container. A tear off strip portion 34 has an inwardly disposed locking flange 38 present on each side of the square. This inwardly disposed locking flange 38 may be interrupted at each corner 60 of the square. The tear off strip portion 34 includes a reduced thickness portion 48 with a window 44 created when tab 50 is engaged with the skirt upper portion 32. The locking flange 38 passes over the reduced thickness portion and depending on the thickness of the flange, it may be necessary to cut through the locking flange and reduced thickness portion in order to break out tab 50. FIG. 11 shows tab 50 broken out of engagement with the skirt upper portion 32. In a certain variation of this embodiment, the locking flange 38 is interrupted at the reduced thickness portion, thereby eliminating the need to cut through the flange 38 and reduced thickness portion 48 with a foreign implement, allowing for easier removal of the tear off strip.

The embodiment of FIG. 11 includes indicator means in the form of a recessed portion 52 with arrows 54 on the skirt upper portion 54 corresponding to each intermittent locking flange 36 segment thereby indicating to the user where to lift the lid when disengaging it from the container. The skirt upper portion is formed with thin membrane windows 40 on either side of the upper locking flange segments 36. As discussed above, windows border on the annual groove 30 between the skirt upper portion 32 and tear off strip portion 34 such that upon removal of the tear off strip portion 34 the windows become downwardly disposed V shaped weakened areas, thereby allowing the upper flange segments 36 between the windows 40 to be more easily lifted and released from the container outwardly disposed upper locking flange 18. The thin membrane windows on the square shaped lid of the invention described and illustrated herein may have the same features and as those windows and variations thereof as described above and shown in the Figures, including but not limited to FIGS. 4, 5, 6 and 7.

In the second embodiment of the square container shown in FIG. 12, there are only two locking flange segments 36 on the inside of skirt upper portion 32, positioned on diametrically opposed sides of the square. This embodiment includes a recessed portion 52 indicating where to lift the lid for disengagement of the upper locking flange segment with the container upper locking flange 18. The tear off strip portion 34 may include a locking flange 38 extending around the entirety of the lid. Alternately, as discussed above and disclosed in the figures, the tear off strip portion 34 may have several discontinuous locking flange segments 38 extending around the lid. For example, the corners 60 of the square may not include the flange segment 38.

The embodiment shown in FIG. 12 may be utilized for containers where the lids need not be held so securely on containers 12. Since the FIG. 11 embodiment include greater means for retention of the lid on the container due to the presence of upper locking flange segments 36 on each side of the square container, the lid of FIG. 11 will be useful for containers where stronger retention between the lid and the container is desired.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A lid for a container having upper and lower peripheral, annular outwardly disposed locking flanges, said flanges having undersides for locking engagement with the container lid, the lid comprising: a central portion and a peripheral skirt adapted to overlie the container locking flanges; the peripheral skirt defining a peripheral groove dividing said skirt into a skirt upper portion located adjacent to the container upper locking flange, and a lower tear-off strip portion located adjacent to the container lower locking flange; the skirt upper portion having inwardly disposed intermittent locking flange segments adapted to engage the underside of the container upper locking flange; the skirt upper portion also being formed with thin membrane windows therein, each said window covered by a thin membrane, said windows positioned circumferentially-adjacent to both sides of the locking flange segments and bordering on the peripheral groove; the skirt upper portion including an outer surface, said outer surface including a recessed portion at the position of said inwardly disposed intermittent locking flange segments, thereby indicating the location of said locking flange segments; and the tear-off strip portion defining an inwardly disposed locking flange adapted to engage the underside of the container lower locking flange, so that removal of the tear-off strip portion leaves downwardly disposed thin membrane notches on either side of the locking flange segments.

2. A lid as claimed in claim 1 wherein the thin membrane windows are formed with openings therethrough bordering on the annular groove, so that removal of the tear-off strip portion leaves downwardly disposed open notches on either side of the locking flange segments.

3. A lid as claimed in claim 1 wherein the thin membrane windows are formed with strengthening ribs therein.

4. A lid as claimed in claim 1 wherein the tear-off strip portion inwardly disposed locking flange is formed of a plurality of spaced-apart flange segments.

5. A lid as claimed in claim 1 wherein the tear-off strip portion is formed with a window located adjacent to the peripheral groove.

6. A lid as claimed in claim 5 wherein the tear-off strip portion has a lower peripheral edge, and wherein the tear-off strip portion is formed with a reduced thickness portion located between the tear-off strip portion window and said lower peripheral edge.

7. A lid as claimed in claim 1 wherein the lid further comprises means defining a peripheral sealing groove located between the lid central portion and the peripheral skirt, the sealing groove being adapted to sealingly engage the rim of the container.

8. A lid as claimed in claim 1 wherein the periphery of the lid and container is rectangular.

9. A lid as claimed in claim 1 wherein the periphery of lid and container is circular.

* * * * *

UNITED STATES PATENT AND TRADEMARK OFFICE

CERTIFICATE OF CORRECTION

PATENT NO. : 6,779,676 B2
DATED : August 24, 2004
INVENTOR(S) : Vince Ciccone

It is certified that error appears in the above-identified patent and that said Letters Patent is hereby corrected as shown below:

Column 6,
Line 63, "a recessed" should read -- at least one recessed --; and
Line 63, after "position of" please insert -- at least one of --.

Signed and Sealed this

Twenty-second Day of February, 2005

JON W. DUDAS
*Director of the United States Patent and Trademark Office*